US008213849B2

(12) United States Patent
Domoto et al.

(10) Patent No.: US 8,213,849 B2
(45) Date of Patent: Jul. 3, 2012

(54) INDUCTIVELY HEATED CARBON NANOTUBE FUSER

(75) Inventors: Gerald A. Domoto, Briarcliff Manor, NY (US); Nicholas P. Kladias, Flushing, NY (US); Kock-yee Law, Penfield, NY (US); Hong Zhao, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 429 days.

(21) Appl. No.: 12/505,850

(22) Filed: Jul. 20, 2009

(65) Prior Publication Data

US 2011/0013954 A1 Jan. 20, 2011

(51) Int. Cl.
*G03G 15/20* (2006.01)
*H05B 6/14* (2006.01)

(52) U.S. Cl. ..... 399/328; 219/619

(58) Field of Classification Search ..... 399/328, 399/329; 219/619

See application file for complete search history.

(56) References Cited

U.S. PATENT DOCUMENTS

| | | | | |
|---|---|---|---|---|
| 7,390,995 | B2 * | 6/2008 | Hasegawa et al. | 219/619 |
| 2005/0152720 | A1 | 7/2005 | Katakabe et al. | |

FOREIGN PATENT DOCUMENTS

| | | | |
|---|---|---|---|
| EP | 1942161 | | 7/2008 |
| JP | 2004026957 | * | 1/2004 |
| JP | 2007179009 | | 7/2007 |
| KR | 20100061107 | | 6/2010 |

OTHER PUBLICATIONS

European Patent Office, European Search Report, European Patent Application No. 10169602.9, Nov. 3, 2010, 7 Pages.

* cited by examiner

*Primary Examiner* — David Gray
*Assistant Examiner* — Joseph S Wong
(74) *Attorney, Agent, or Firm* — MH2 Technology Law Group LLP

(57) ABSTRACT

Systems and methods of inductively heating a fuser member in an electrophotographic device are disclosed. The systems and methods can include a heating component with a susceptor layer comprising carbon nanotubes (CNTs). An excitation unit with an electrical coil can be positioned a proximate distance from the heating component. Current through the electrical coil can inductively heat the susceptor layer and the heating component. The heat from the susceptor layer and the heating component can be used to fuse toner onto an image-receiving substrate. The CNTs can reduce electronic hardware costs in the electrophotographic device in relation to the costs associated with conventional materials.

23 Claims, 7 Drawing Sheets

INDUCTIVELY HEATED CARBON NANOTUBE FUSER

FIELD OF THE INVENTION

The present teachings generally relate to printing systems, particularly electrophotographic and ink jet printing systems and methods. More specifically, the systems and methods comprise fusing components utilizing carbon nanotubes (CNTs) or other carbon-based materials.

BACKGROUND OF THE INVENTION

In various image forming devices, toner images are formed on a photoreceptor and then transferred directly to receiving substrates. In other various systems and methods, toner images are transported to fuser rolls or belts and then fixed onto the receiving substrate by heat and pressure. Specifically, the fuser rolls and belts can be heated to melt and press the toner onto the substrates when the substrates pass through the rolls and belts. Various fuser roll systems include a heated fuser roller and a pressure roller to form a nip through which a receiving substrate can pass. The receiving substrate, before passing through the nip, contains previously deposited toner. The heated fuser roll in combination with the pressure roll acts to melt and press the previously deposited toner onto the receiving substrate. Various belt systems can also act to melt and press toner onto the receiving substrate. In both cases, the fusing of the toner particles generally takes place when the proper combination of heat, pressure, and contact time are provided.

The use of thermal energy for fusing toner images onto a substrate is well known in the art. Heat generation in conventional fusing systems can be accomplished by using heaters inside the fuser member, such as quartz rods or lamps located inside the fuser roll. Heat is transferred from the rods or lamps to the outer surface of the fuser roll. Other fusing systems use inductive heating of the fuser member layers such as the fuser roll and the fusing belt. In an inductive heating system, an electrical coil is disposed in close proximity to a heatable fuser member. Alternating current (AC) is sent through an electrical induction coil which generates a magnetic field, which induces eddy currents in the fuser member to heat the fuser member.

In conventional inductive heating fuser systems, metals such as nickel, copper, silver, aluminum, and the like are used as susceptor layers in the heatable fuser members. However, these metals require a high amount of current through the induction coil to heat to a target temperature. Further, high currents in the induction coil can lead to circuit losses and inefficiencies in the fuser system. Still further, optimal heat generation is not achieved with existing combinations of thicknesses and resistivities of the susceptor layers.

Thus, there is a need for an induction heating system with a susceptor layer comprising materials that will require lower currents in the induction coil to reach a target temperature, resulting in a smaller and more cost efficient power supply as well as a higher energy efficiency for the printing process. Further, there is a need for susceptor layers with the right thickness and resistivity combination for optimal heat generation. As such, circuit losses will be minimized throughout the components to lead to a more efficient induction heating system.

SUMMARY OF THE INVENTION

In accordance with the present teachings, an induction fusing system is provided. The induction fusing system comprises a heating component configured to contact an image receiving substrate and fuse toner deposited on the image receiving substrate, and comprising a susceptor layer that comprises a plurality of carbon nanotubes (CNTs). Further, the induction fusing system comprises an electrical coil positioned in proximity to the heating component and configured to conduct an electrical current, wherein inductive heating of the susceptor layer results when the electrical current is applied to the electrical coil.

In accordance with the present teachings, an induction fusing system is provided. The induction fusing system comprises a heating component configured to contact an image receiving substrate and fuse toner deposited on the image receiving substrate, and comprising a susceptor layer with a resistivity/thickness in a range of about 0.01 ohm-cm/cm to about 4.0 ohm-cm/cm. Further, the induction fusing system comprises an electrical coil positioned in proximity to the heating component and configured to conduct an electrical current, wherein inductive heating of the susceptor layer results when the electrical current is applied to the electrical coil.

In accordance with the present teachings, a method for inductively heating a fusing member is provided. The method comprises the steps of providing a heating component comprising at least one layer of CNTs, providing an electrical coil located in proximity to the heating component, and conducting an electrical current through the electrical coil. Further, the method comprises inductively heating the at least one layer of CNTs via the electrical current, and rotating the heated at least one layer of CNTs to fuse toner to an image-receiving substrate.

It is to be understood that both the foregoing general description and the following detailed description are exemplary and explanatory only and are not restrictive of the present teachings, as claimed.

The accompanying drawings, which are incorporated in and constitute a part of this specification, illustrate several embodiments of the present teachings and together with the description, serve to explain the principles of the present teachings.

DESCRIPTION OF THE EMBODIMENTS

Figure 1:
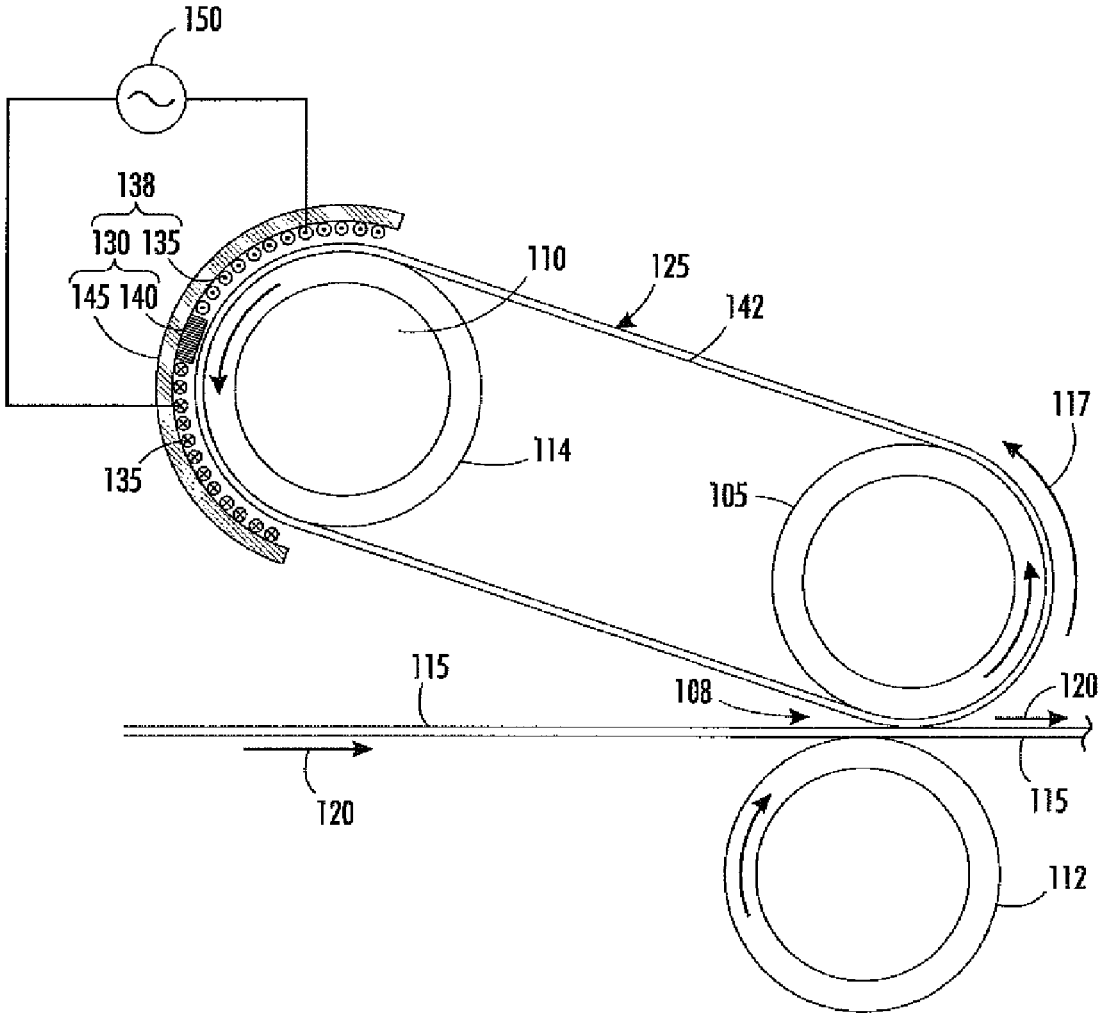
FIG. 1 depicts an exemplary method and system for an induction heated fuser belt according to the present teachings.

Reference will now be made in detail to the exemplary embodiments of the present teachings, examples of which are illustrated in the accompanying drawings. Wherever possible, the same reference numbers will be used throughout the drawings to refer to the same or like parts.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

It should be appreciated that the exemplary systems and methods depicted in FIGS. 1-7 can be employed for any fusing system in any electrophotographic apparatus. Further, the fusing systems described herein can employ any system, method, or configuration for induction heating. The following descriptions are therefore merely exemplary.

An image forming apparatus adopting electrophotography generally can form an electrostatic latent image on the surface of a latent image receptor and bring charged toner into contact with the surface of the receptor to form a toner image. The toner image can be transferred to an image-receiving substrate where the image is fused thereto by heat and/or pressure, thereby providing an image. In such an apparatus, a fusing system comprising a fuser roll and a pressure roll abutting each other can be used to fuse the toner onto the image receiving substrate. In particular, a nip can be formed between the fuser roll and the pressure roll, whereby the toner can be fused by heat and pressure when the image receiving substrate enters the nip.

The fusing system can have a heat generating component which can heat up during the fusing process. In the fusing system, it is desired to lessen the warm-up time necessary to heat the heat generating component to a temperature high enough for the toner melting and fusing operations, from the viewpoint of energy saving and the preventing the user from waiting when using the imaging apparatus. Further, the cost of the electrical and electronic hardware in the fusing system can be reduced, the system design can be simplified, and system efficiency can improve as a result of a faster warm-up time.

Induction heating techniques can be used to lessen the warm-up time. In these techniques, an electrical coil can be used to generate a magnetic field in close proximity to the heat generating component. The magnetic field can lead to a current, called an eddy current, to be induced in the conductive heat generating component. The eddy current can generate heat, and power dissipated in the heat generating component in the form of heat is known as an eddy current loss. The heat generating component can comprise a conductive susceptor layer capable of producing eddy current losses and therefore generating heat. It is desired to produce large eddy current losses with little electrical output.

In present embodiments, the conductive susceptor layers in the heat generating components can comprise non-woven carbon nanotubes (CNTs) and/or other carbon-based materials. The non-woven CNTs can comprise a sheet and can minimize the current necessary to heat the components to target temperatures, simplify system design, and minimize the costs of the electrical and electronic hardware in the system. Further, textiles made from CNTs have a high tensile strength and a high thermal conductivity which makes the textiles a desirable belt material. Therefore, the use of CNT non-woven sheets as susceptor layers can enable a more efficient fusing system. Further, in present embodiments, the susceptor layers can have a resistivity and thickness combination that can optimize the amount of heat generation. It should be understood that the susceptor layers should not be limited to CNT materials to achieve the optimal resistivity and thickness combination, and can comprise other carbon-based or metallic materials.

As used herein and unless otherwise specified, the terms "nanotubes" and "CNTs" refer to elongated materials (including organic and inorganic materials) having at least one minor dimension, for example, width or diameter, about 100 nanometers or less. The nanotubes can be a non-woven sheet and can be non-alighted, or aligned via solvent treatment or mechanical stretch. The nanotubes can be a sheet comprising essentially all carbon, but can also contain a small amount of polymeric materials as a result of the device fabrication process.

In various embodiments, the nanotubes can have an inside diameter and an outside diameter. For example, the inside diameter can range from about 0.5 to about 20 nanometers, while the outside diameter can range from about 1 to about 80 nanometers. The nanotubes can have an aspect ratio, e.g., ranging from about 1 to about 10000. Further, the length of the nanotubes can range from about 100 nm to about 0.5 cm.

The terms "nanotubes" and "CNTs" can also include single wall nanotubes such as single wall carbon nanotubes (SWCNTs), double-walled nanotubes, or multi-wall nanotubes such as multi-wall carbon nanotubes (MWCNTs), and their various functionalized and derivatized fibril forms such as nanofibers. The terms "nanotubes" and "CNTs" can further include carbon nanotubes including SWCNTs and/or MWCNTs. Furthermore, the terms "nanotubes" and "CNTs" can include modified nanotubes from all possible nanotubes described thereabove and their combinations. The modification of the nanotubes can include a physical and/or a chemical modification.

The nanotubes can be formed of conductive or semi-conductive materials. In some embodiments, the nanotubes can be obtained in low and/or high purity dried paper forms or can be purchased in various solutions. In other embodiments, the nanotubes can be available in the as-processed unpurified condition, where a purification process can be subsequently carried out.

The nanotubes can provide exceptional and desired functions, such as, mechanical, electrical (e.g., conductivity), and thermal (e.g., conductivity) functions to the coating composition and the coated article. In addition, the nanotubes can be modified/functionalized nanotubes with controlled and/or increased mechanical, electrical or thermal properties through various physical and/or chemical modifications.

In the present embodiments, the induction technique can be applied to any suitable members of a fusing system. For example, the heat generating component can be applied to any of a roll-shaped member such as, for example, a fuser roll, a pressure roll, or a member shaped like an endless belt (fuser belt) replacing either or both of the fuser roll and the pressure roll as the heating member. Further, for example, the electrical coil can be positioned in proximity to any of the members of the fusing system, such as, for example, the fuser roll, the pressure roll, and/or the fuser belt. Still further, the electrical coil can be configured in any way or form which can enable the generation of a magnetic field and corresponding eddy current loss. For example, induction system can be configured according to any of the systems and methods described in U.S. Pat. Nos. 6,725,010, 7,369,802, and 6,989,516; the entire disclosures each of which are incorporated by reference herein in their entirety.

FIG. 1 depicts an exemplary method and system for an induction heated fuser belt within a fuser belt system. The exemplary fuser belt system can be present in an electrostatographic imaging apparatus such as, for example, a laser printer.

In the present embodiments, a fusing station 100 can be configured with a fuser roll 105, a supporting roll 110, a pressure roll 112, and a substrate transport 115. The arrows on the fuser roll 105, the supporting roll 110, and the pressure roll 112 can indicate the rotational direction of each roll. The fuser roll 105 can have a low thermal conductivity, and can be optionally coated with silicone rubber. The supporting roll 110 can have an insulating layer 114 to protect the supporting roll 110 from heat increases. A heating belt 125 can be rotationally suspended with a predetermined tensile force between the supporting roll 110 and the fuser roll 105. The heating belt 125 can rotate in combination with the supporting roll 110 and the fuser roll 105 in the direction as indicated by 117. Ribs (not shown in the figures) can be on both ends of the supporting roll 110 and the fuser roll 105 to prevent the heating belt 125 from sliding off the respective rolls. The heating belt 125 can comprise a heat generating component 142 than can inductively generate heat in accordance with the embodiments described herein. In embodiments, the heating belt 125 can comprise a plurality of layers, as described in FIG. 3 of the present description.

The pressure roll 112 can be in contact under pressure with the fuser roll 105 through the heating belt 125, so that a nip 108 can be formed between the heating belt 125 and the pressure roll 112. The substrate transport 115 can direct an image-receiving substrate with a transferred toner powder image through the nip 108 along a direction indicated by an arrow 120. Heat from the heating belt 125 and pressure from the nip 108 can melt and fuse the toner powder image to the image-receiving substrate.

The fusing station 100 can be configured with a rear core 130 that together with an excitation coil 135 can form an excitation unit 138 that can be located in proximity to the supporting roll 110 and the heating belt 125. The rear core 130 can be comprised of a central core 140 and a U-shaped core 145 that can be connected magnetically or via other means. The central core 140 can pass through a center axis of the excitation coil 135 and can, along with the U-shaped core 145, be in line with a center of the supporting roll 110 and the fuser roll 105. The rear core 130 can be made of a material having a high magnetic permeability such as, for example, ferrite. However, a material having somewhat low magnetic permeability can be used as well. Further, the rear core 130 can shield electromagnetic layers from dissipating throughout the fusing station 100. In embodiments, the excitation unit 138 can be configured in any way such to allow induction heating in the fusing station 100 as described herein, including in embodiments without a central core 140.

The excitation coil 135 can have a varying coil density and can conduct electrical current produced from an excitation circuit 150 or any power supply capable of transmitting a current through the excitation coil 135. The excitation circuit 150 can be an AC power supply and can operate at a variable current and frequency. For example, the excitation circuit 150 can output a current in the range of about 0.5 Amperes (A) to about 10 A, at a frequency in the range of about 25 kilohertz (kHz) to about 700 kHz, or in any combination thereof. However, it should be appreciated that the excitation circuit 150 can output a current with different values. When the excitation circuit 150 outputs a current through the excitation coil 135, a magnetic field is created in a region proximate to the excitation coil 135. The magnetic field can cause the induction of an eddy current and the generation of heat in the heat generating component 142 of the heating belt 125. The heat generating component 142 can therefore dissipate heat resulting from the eddy current without any physical contact between the heating belt 125 and the excitation coil 135.

The heat from the heat generating component 142 can dissipate to the heating belt 125, which, in rotational combination with the fuser roll 105, the supporting roll 110, and the pressure roll 112, can provide enough heat to fix the transferred toner powder image to the image-receiving substrate. More specifically, the heating belt 125 can heat the transferred toner when the image-receiving substrate is at the nip 108 so that the toner is affixed to the substrate.

Figure 2:
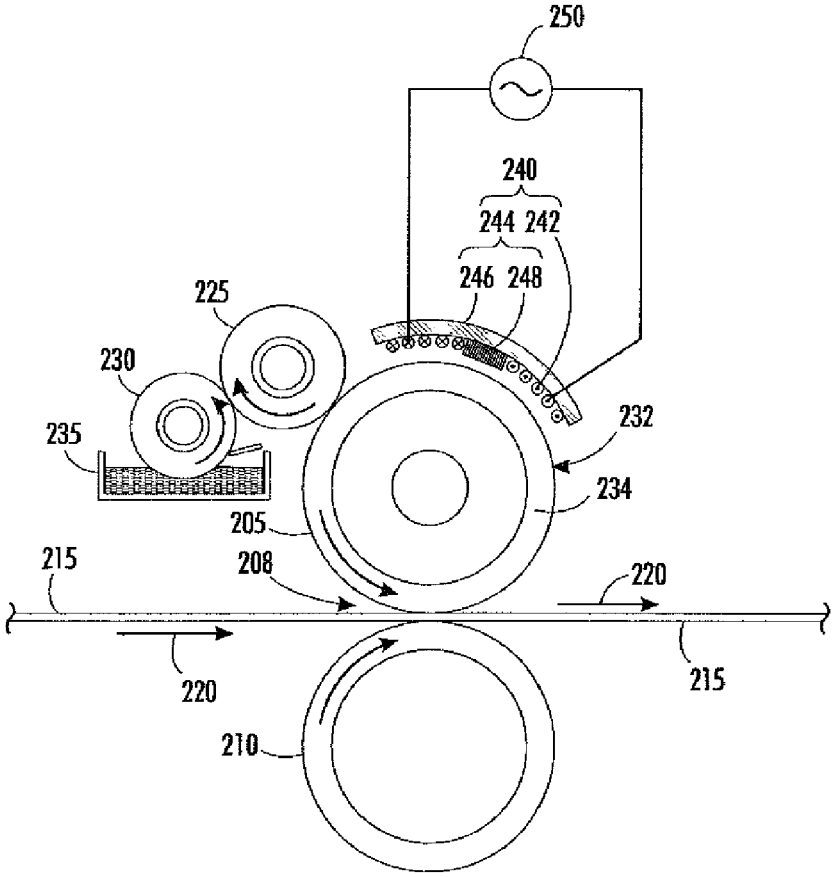
FIG. 2 depicts an exemplary method and system for an induction heated fuser roll according to the present teachings.

FIG. 2 depicts an exemplary method and system for an induction heated fuser roll within a fuser roll system. The exemplary fuser roll system can be present in an electrostatographic imaging apparatus such as, for example, a laser printer.

In the present embodiments, a fusing station 200 can include a fuser roll 205, a pressure roll 210, and a substrate transport 215. The substrate transport 215 can direct an image-receiving substrate with a transferred toner powder image through a nip 208 between the fuser roll 205 and the pressure roll 210 along a direction indicated by an arrow 220. The arrows on the fuser roll 205 and the pressure roll 210 can indicate the rotational direction of each roll, and the fuser roll 205 can be in rotational combination with the pressure roll 210. The pressure roll 210 can be in contact under pressure with the fuser roll 205 so that a nip 208 can be formed between the fuser roll 205 and the pressure roll 210. Heat generated in the fusing station 200 and pressure from the nip 208 can melt and fuse the toner powder image to the image-receiving substrate.

The fusing system 200 can further include a donor roll 225, a metering roll 230, and a reservoir 235. The donor roll 225 and the metering roll 230 can be rotatably mounted in the direction indicated by the arrows. The donor roll 225 can be in rotational combination with the fuser roll 205, and the metering roll 230 can be in rotational combination with the donor roll 225. The reservoir 235 can hold a release agent which can be provided to the metering roll 230. The metering roll 230 can deliver the release agent to the surface of the donor roll 225. As the donor roll rotates in contact with the fuser roll 205, a thin film of the release agent on the donor roll 225 can be transferred to the fuser roll 205, with a thin portion of the release agent being retained on the donor roll 225 to aid in the removal of built-up toner and other contamination on the fuser roll 205.

The fuser roll 205 can comprise an outer surface 232 that can receive the release agent from the donor roll 225. The outer surface 232 can comprise a heat generating component 234 that can inductively generate heat in accordance with the embodiments described herein. In embodiments, the outer surface 232 can comprise a plurality of layers, as described in FIG. 3 of the present description. Further, in embodiments, the outer surface 232 can be present on any combination of the fuser roll 205, the donor roll 225, and/or the pressure roll 210, so as to inductively generate heat in the fusing station 200.

The fusing station 200 can be configured with a rear core 244 that together with an excitation coil 242 can form an excitation unit 240 that can be located in proximity to the fuser roll 205. In embodiments, the excitation unit 240 can be located in proximity to any combination of the fuser roll 205, the donor roll 225, and/or the pressure roll 210. The rear core 244 can be comprised of a central core 248 and a U-shaped core 246 that can be connected magnetically or via other means. The central core 248 can pass through a center axis of the excitation coil 242 and can, along with the U-shaped core 246, be in line with a center of the fuser roll 205. The rear core 244 can be made of a material having a high magnetic permeability such as, for example, ferrite. However, a material having somewhat low magnetic permeability can be used as well. Further, the rear core 244 can shield electromagnetic layers from dissipating throughout the fusing station 200. In embodiments, the excitation unit 240 can be configured in any way such to allow induction heating in the fusing station 200 as described herein, including in embodiments without a central core 248.

The excitation coil 242 can have a varying coil density and can conduct electrical current produced from an excitation circuit 250 or any power supply capable of transmitting a current through the excitation coil 242. The excitation circuit 250 can be an AC power supply and can operate at a variable current and frequency. For example, the excitation circuit 250 can output a current in the range of about 0.5 A to about 10 A, at a frequency in the range of about 25 kHz to about 700 kHz, or in any combination thereof. However, it should be appreciated that the excitation circuit 250 can output a current with different values. When the excitation circuit 250 outputs a current through the excitation coil 242, a magnetic field is created in a region proximate to the excitation coil 242. The magnetic field can cause the induction of an eddy current and the generation of heat in the heat generating component 234 of the outer layer 232. The heat generating component 234 can therefore dissipate heat resulting from the eddy current without any physical contact between the outer layer 232 and the excitation coil 242.

The heat from the heat generating component 234 can dissipate to the outer layer 232, which, in rotational combination with the fuser roll 205 and the pressure roll 210, can provide enough heat to fix the transferred toner powder image to the image-receiving substrate. More specifically, the outer surface 232 can heat the transferred toner when the image-receiving substrate is at the nip 208 so that the toner is affixed to the substrate.

Figure 3:
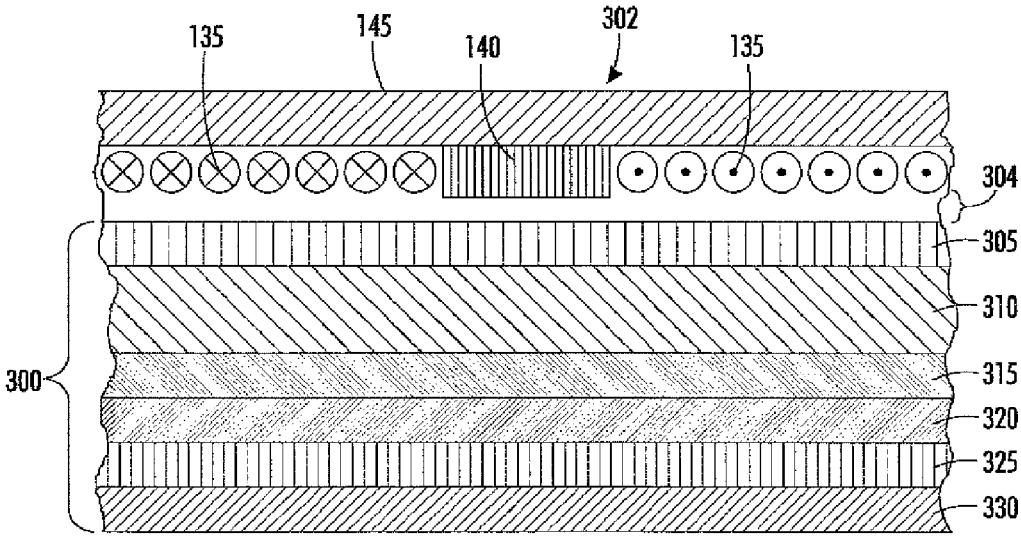
FIG. 3 depicts an exemplary cross section of an exemplary excitation unit and an inductive heating component according to the present teachings.

FIG. 3 depicts an exemplary cross section of an exemplary excitation unit 302 and an inductive heating component 300, according to systems and methods as described herein. The excitation unit 302 can comprise the central core 140, the U-shaped core 145, and the excitation coil 135 as described herein. Further, the excitation coil 135 can comprise coils of varying thickness and density, according to the systems and methods described herein. In embodiments, the excitation unit 302 can be any component capable of generating a current and subsequent magnetic flux. The inductive heating component 300 can be the heating belt 125, as described with respect to FIG. 1, the outer surface 232, as described with respect to FIG. 2, or any other component capable of dissipating heat in a fusing system. The inductive heating component 300 can be positioned a proximate distance 304 from the excitation unit 302. The proximate distance 304 can be in the range of about 10 μm to about 100 μm. The inductive heating component 300 is merely exemplary and can comprise different combinations, materials, and thicknesses of the comprising layers as depicted and described herein.

As depicted in FIG. 3, the inductive heating component 300 can comprise a release layer 305 and a silicone layer 310. The release layer 305 can be the outside layer of the inductive heating component 300 and can contact an image-receiving substrate at the nip 108, as shown in FIG. 1. In embodiments, the release layer 305 can be comprised of a material which inhibits toner from adhering thereon during the toner fusing stage. In embodiments, the release layer 305 can receive a toner release agent to further prevent toner build-up, as described with respect to FIG. 2. The release layer 305 can have a thickness in the range of about 10 μm to about 50 μm, or other values. The silicone layer 310 can support the release layer 305 and can have a thickness in the range of about 100 μm to about 3 mm, or other values.

The inductive heating component 300 can further comprise a first susceptor layer 315 and a second susceptor layer 320. In embodiments, the inductive heating component 300 can comprise a single susceptor layer. The susceptor layers 315, 320 can be a conductive material and can absorb electromagnetic energy and convert the energy into heat. In particular, when in the presence of a magnetic field produced from current in the excitation unit 302, the susceptor layers 315, 320 can induce a flow of an eddy current and a dissipation of heat from the eddy current, and an eddy current loss can result from the dissipation of the heat in the susceptor layers 315, 320. The dissipating heat in the susceptor layers 315, 320 can heat each or any of the other layers of the inductive heating component 300.

In the present embodiments, the first susceptor layer 315 and the second susceptor layer 320 can each be comprised of carbon nanotubes (CNTs) and/or other carbon-based materials. The use of CNTs can minimize the coil current in the excitation unit 302 required to heat the susceptor layers 315, 320 as well as minimize the circuit losses associated with high currents. Further, CNTs have a high tensile strength and a high thermal conductivity which can make CNTs a desirable material to aid in the longevity of a fuser belt and improve the efficiency of an induction heating system, respectively. In embodiments, the susceptor layers 315, 320 can each have a thickness in the range of about 10 μm to about 100 μm, or other values. Further, in embodiments, the first susceptor layer 315 and the second susceptor layer 320 can each have a resistivity in the range of about 0.0001 ohm-cm to about 0.002 ohm-cm. Accordingly, the susceptor layers 315, 320 can have a resistivity/thickness in the range of 0.025 ohm-cm/cm to about 2.0 ohm-cm/cm. It should be appreciated that the ranges of the values disclosed herein can vary depending on various factors such as, for example, the alignment, arrangement, and geometry of the susceptor layers 315, 320 and corresponding components.

The inductive heating component 300 can further comprise a base layer 325 and an electromagnetic layer 330. The base layer 325 can support the susceptor layers 315, 320 and can have a thickness in the range of about 30 μm to about 150 μm, or other values. The electromagnetic layer 330 can shield components in the system from electromagnetic waves and can be in the range of about 20 μm to about 50 μm, or other values. Further, the electromagnetic layer 330, as part of the heating belt 125 as depicted in FIG. 1, can contact the supporting roll 110 and the fuser roll 105. Further, in fuser roll induction heating system embodiments, the electromagnetic layer 330 can be part of the outer surface 232 and can contact the fuser roll 205, as depicted in FIG. 2.

Figure 4:
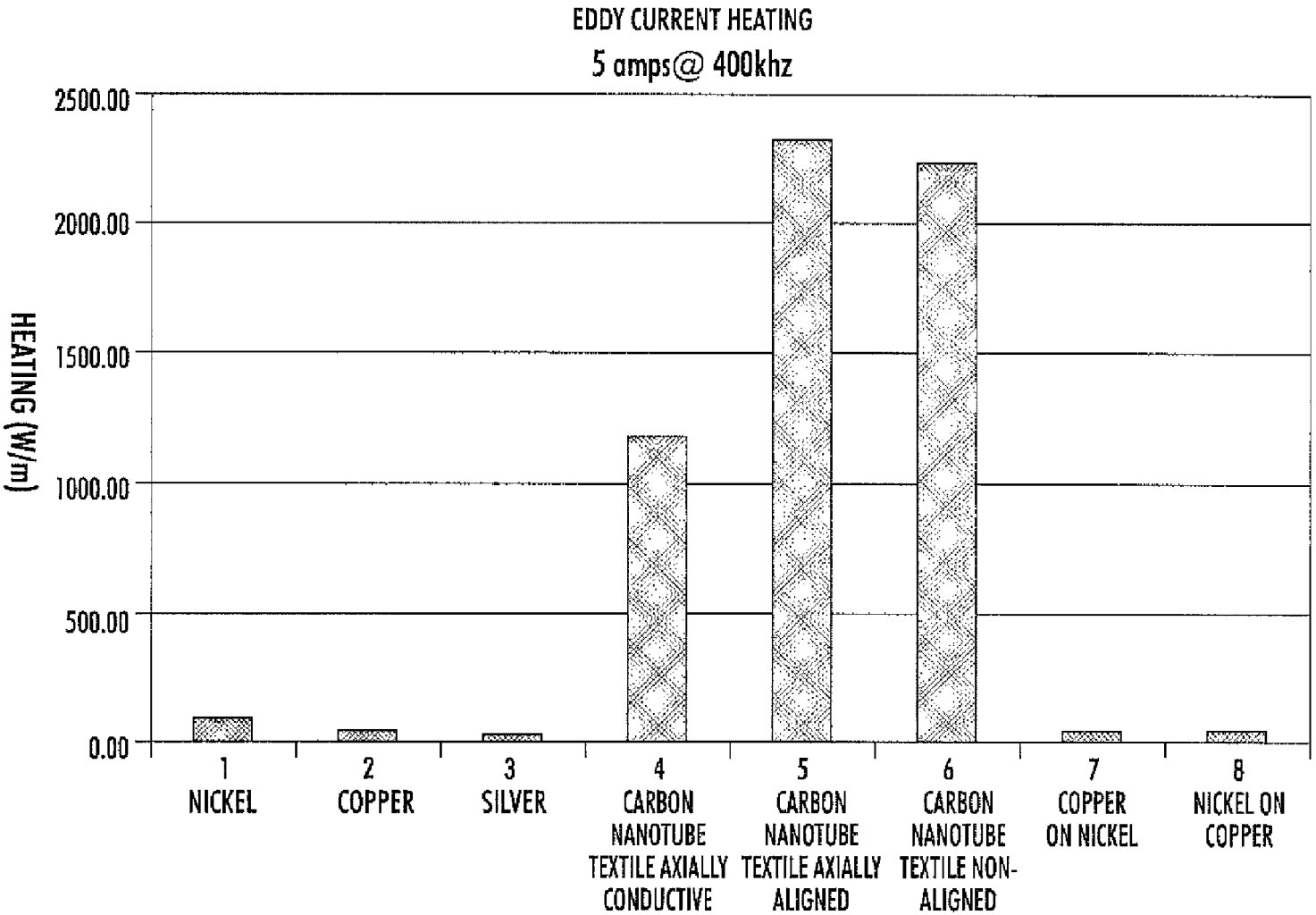
FIG. 4 is a chart depicting eddy current heating in susceptor layers according to the present teachings.

FIG. 4 is a chart depicting eddy current heating in susceptor layers of differing materials of equal thickness. The measurements of test cases 1-8 contained in FIG. 4 were obtained when a current of 5 A at a frequency of 400 kHz was applied to an induction coil. For each test case 1-8, the eddy current heating, in watt/meter (W/m), of two susceptor layers, as described with respect to FIG. 3, were measured. In the first three (test cases 1, 2, and 3) and the last two (test cases 7 and 8) test cases, conventional metallic materials were used as the susceptor layers. In particular, test case 1 used nickel as both of the susceptor layers, test case 2 used copper as both of the susceptor layers, test case 3 used silver as both of the susceptor layers, test case 7 used a copper susceptor layer on top of a nickel susceptor layer, and test case 8 used a nickel susceptor layer on top of a copper susceptor layer.

In test cases 4, 5, and 6, CNTs were used as the susceptor layers. In particular, test case 4 used axially-conductive CNTs with a resistivity of 0.0001 ohm-cm as both of the susceptor layers, test case 5 used axially-aligned CNTs with a resistivity of 0.00025 ohm-cm as both of the susceptor layers, and test case 6 used non-aligned CNTs with a resistivity of 0.0008 ohm-cm as both of the susceptor layers.

As shown in FIG. 4, in the conventional metallic material test cases (test cases 1, 2, 3, 7, and 8), the eddy current heating of the susceptor layers ranged from about 100 W/m to about 200 W/m. In contrast, in the CNT material test cases (test cases 4, 5, and 6), the eddy current heating of the susceptor layers ranged from about 1,250 W/m to about 2,350 W/m, with the highest case being the axially-aligned CNTs (test case 5). The overall results indicated that susceptor layers of CNTs generated a larger eddy heating current than did conventional metals for the same applied current. As such, more heat was generated for the same amount of energy output, which can lead to a more efficient overall system.

Figure 5:
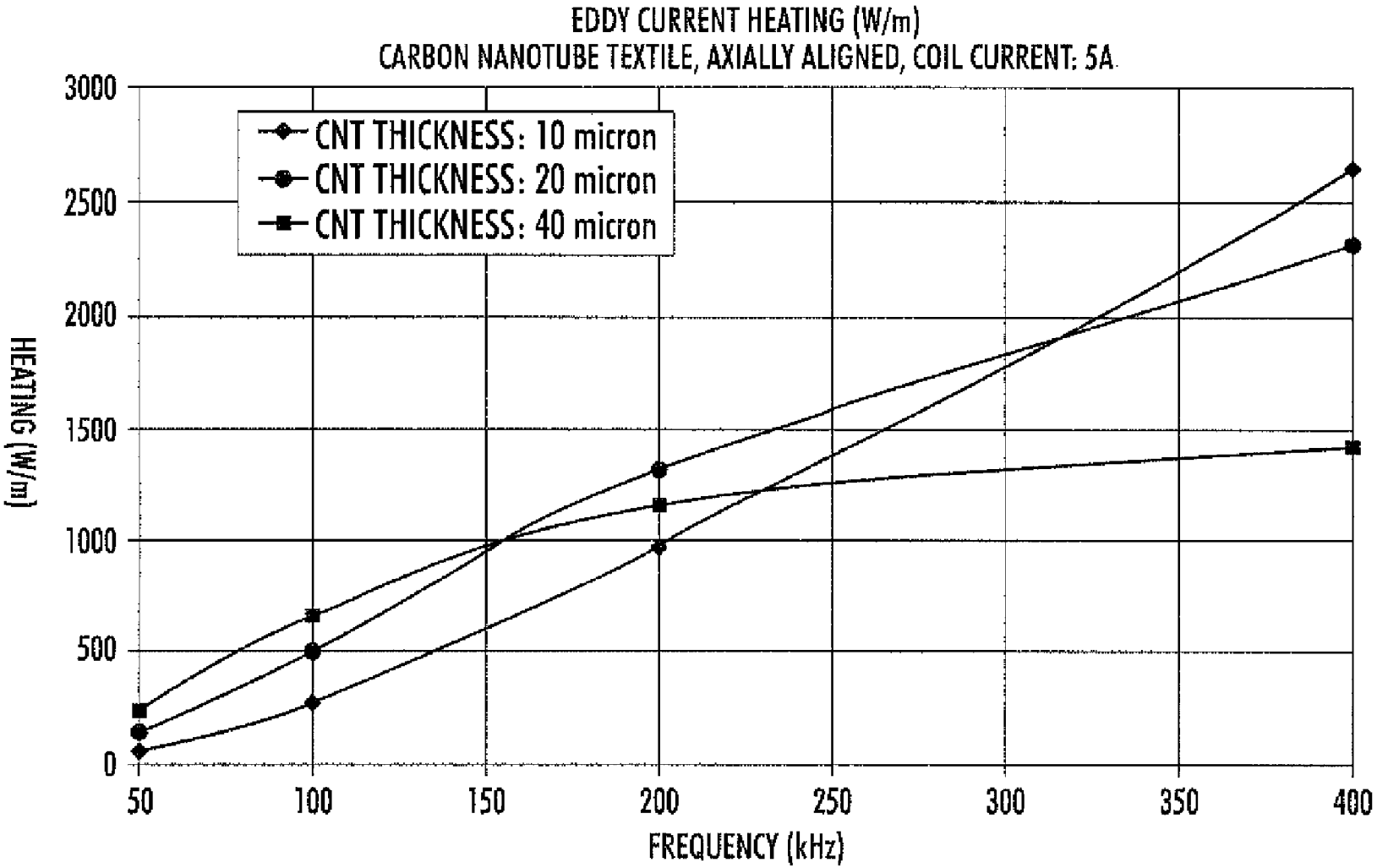
FIG. 5 is a chart depicting eddy current heating in susceptor layers according to the present teachings.

FIG. 5 is a chart depicting eddy current heating in susceptor layers of axially-aligned CNTs of different thicknesses with different applied frequencies. The measurements contained in FIG. 5 were obtained when a current of 5 A at varied frequencies was applied to an induction coil, inducing an eddy current in the corresponding susceptor layer. Three test cases are depicted: a CNT susceptor layer with a thickness of 10 μm, a CNT susceptor layer with a thickness of 20 μm, and a CNT susceptor layer with a thickness of 40 μm. Further, the frequency of the applied current was varied for each test case. In particular, currents with frequencies of 50 kHz, 100 kHz, 200 kHz, and 400 kHz were applied to each test case.

As shown in FIG. 5, the eddy current heating increased in each test case as the applied frequency increased. Further, as shown in FIG. 5, the thickness of the respective CNT susceptor layers did not substantially affect the eddy current heating across the different applied frequencies, except in the case of the 40 μm-thick CNT susceptor layer at a 400 kHz frequency. Therefore, in general, the thickness of the CNT susceptor layer did not substantially affect the substantially linear relationship between the applied frequency and the resulting eddy current heating, especially in the cases where the applied frequency was 50 kHz, 100 kHz, and 200 kHz.

Figure 6:
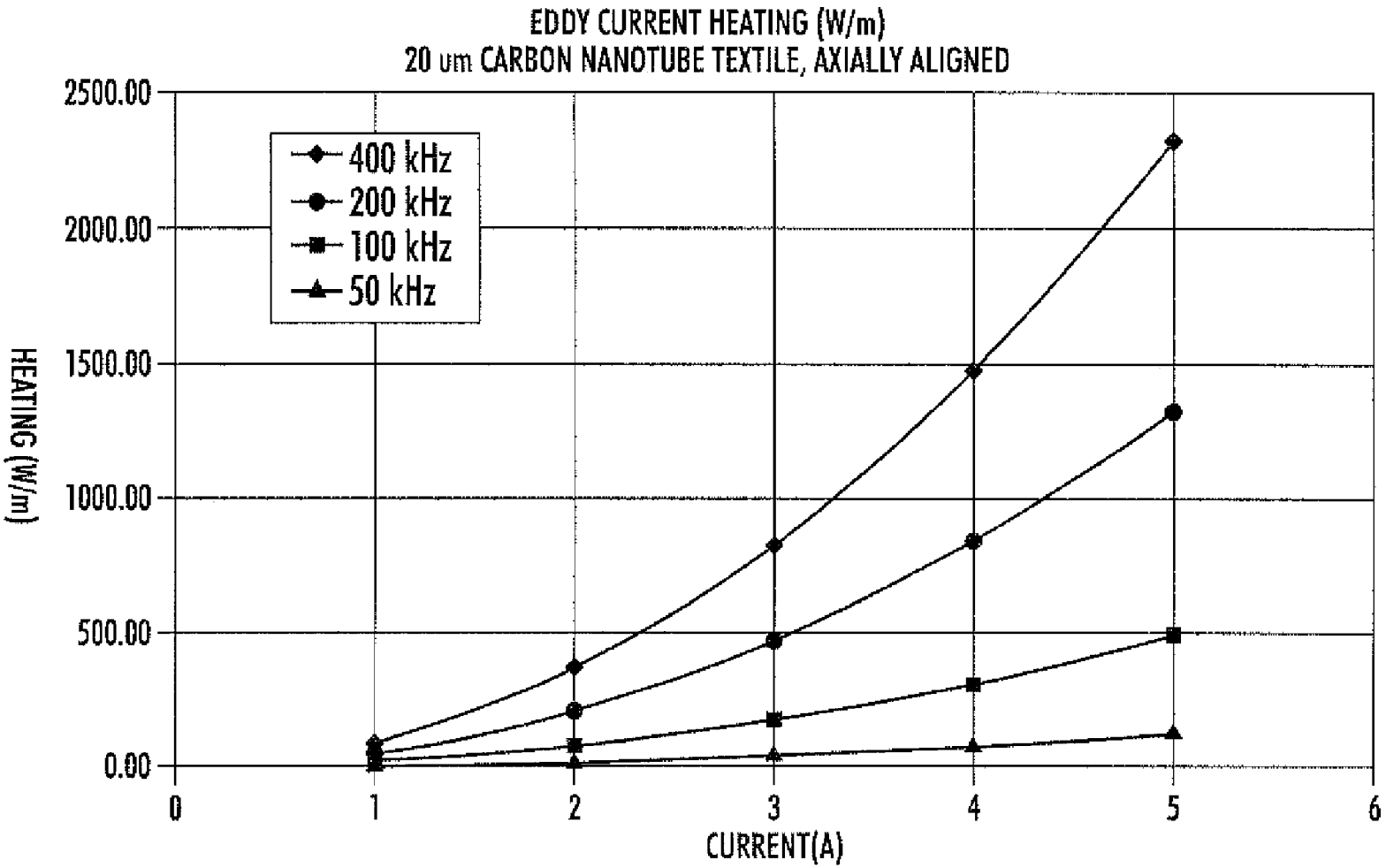
FIG. 6 is a chart depicting eddy current heating in susceptor layers according to the present teachings.

FIG. 6 is a chart depicting eddy current heating in a CNT susceptor layer across different applied currents. The measurements contained in FIG. 6 were obtained when various currents at various frequencies were applied to an induction coil to induce an eddy current in an axially-aligned CNT susceptor layer with a thickness of 20 μm. Four test cases of differing frequencies were conducted. In particular, four tests cases were conducted where the applied frequency was 50 kHz, 100 kHz, 200 kHz, and 400 kHz, respectively. Further, the current applied to the induction coil was varied for each test case. In particular, currents of 1.0 A, 2.0 A, 3.0 A, 4.0 A, and 5.0 A were applied to each test case.

As shown in FIG. 6, the eddy current heating increased in each test case as the applied current increased. Further, as shown in FIG. 6, the measured eddy current heating increased as the applied frequencies of the test cases increased. In particular, the measured eddy current heating in the 50 kHz test case with an applied current of 5.0 A was 138 W/m, while the measured eddy current heating in the 400 kHz test case with an applied current of 5.0 A was 2322 W/m. Still further, as shown in FIG. 6, the measured eddy current heating in each test case increased substantially as the current was increased from 1.0 A to 5.0 A. The results depicted in FIG. 6 indicated that, in combination with the chart of FIG. 4, cases that utilized a CNT susceptor layer could achieve approximately the same eddy current heating as that of a conventional susceptor layer at a lower frequency and/or applied current. In particular, a nickel susceptor layer achieved an eddy current heating of about 200 W/m when 5.0 A at 400 kHz was applied to an induction coil, while a CNT susceptor layer achieved an eddy current heating of 211.93 W/m when 2.0 A at 200 kHz was applied to an induction coil. Therefore, fusing systems using CNT susceptor layers can be more efficient with less electrical output and costs than fusing systems that use conventional susceptor layers.

Figure 7:
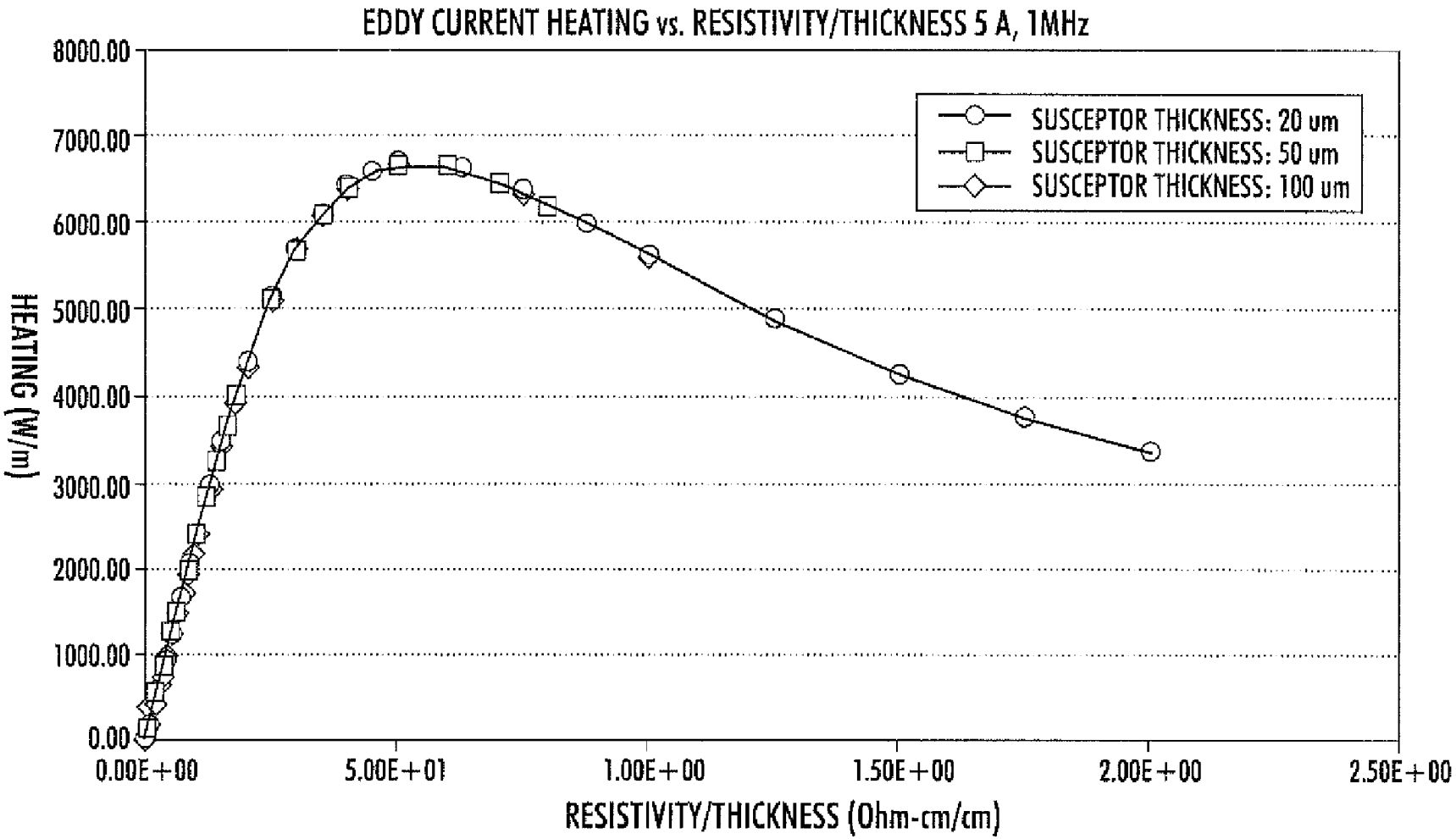
FIG. 7 is a chart depicting eddy current heating in susceptor layers according to the present teachings.

FIG. 7 is a chart depicting eddy current heating in susceptor layers of different thicknesses and resistivities. The measurements in the test cases depicted in FIG. 7 were obtained when a current of 5 A at a frequency of 1 MHz was applied to an induction coil. For each test case, the eddy current heating per unit length (W/m), of the susceptor layer, as described with respect to FIG. 3, was calculated.

The susceptor layers in the test cases had various resistivities and thicknesses. The X-axis of FIG. 7 depicts the resistivity/thickness, in ohm-cm/cm, for each test case. For example, if the susceptor layer has a thickness of 20 μm and a resistivity of 0.001 ohm-cm, then the susceptor layer has a resistivity/thickness of 5.00E-01, or 0.5, ohm-cm/cm. In some of the test cases, CNTs were used as the susceptor layers. It should be appreciated that an optimal eddy current heating of the susceptor layers at a similar resistivity/thickness can be achieved using susceptor layers of other materials, such as other carbon-based or conventional metallic materials, or any other materials with the optimal resistivity/thickness ratio as discussed herein.

As shown in FIG. 7, various susceptor layer combinations were used to vary the resistivity/thickness from about 0.0 ohm-cm/cm to about 2.0 ohm-cm/cm. Further, as shown in FIG. 7, the eddy current heating increased rapidly as the resistivity/thickness of the susceptor layers increased from about 0.0 ohm-cm/cm to about 0.4 ohm-cm/cm, with the eddy current heating reaching a peak of about 6700 W/m when the resistivity/thickness was about 0.5 ohm-cm/cm. Further, as shown in FIG. 7, the eddy current heading declined steadily to about 3300 W/m as the resistivity/thickness increased from about 0.5 ohm-cm/cm to about 2.0 ohm-cm/cm. The overall results indicate that at an applied frequency of 1 MHz, the susceptor layers had an optimal eddy current heating when the resistivity/thickness of the susceptor layers was in the range of about 0.4 ohm-cm/cm to about 0.8 ohm-cm/cm.

Figure 8:
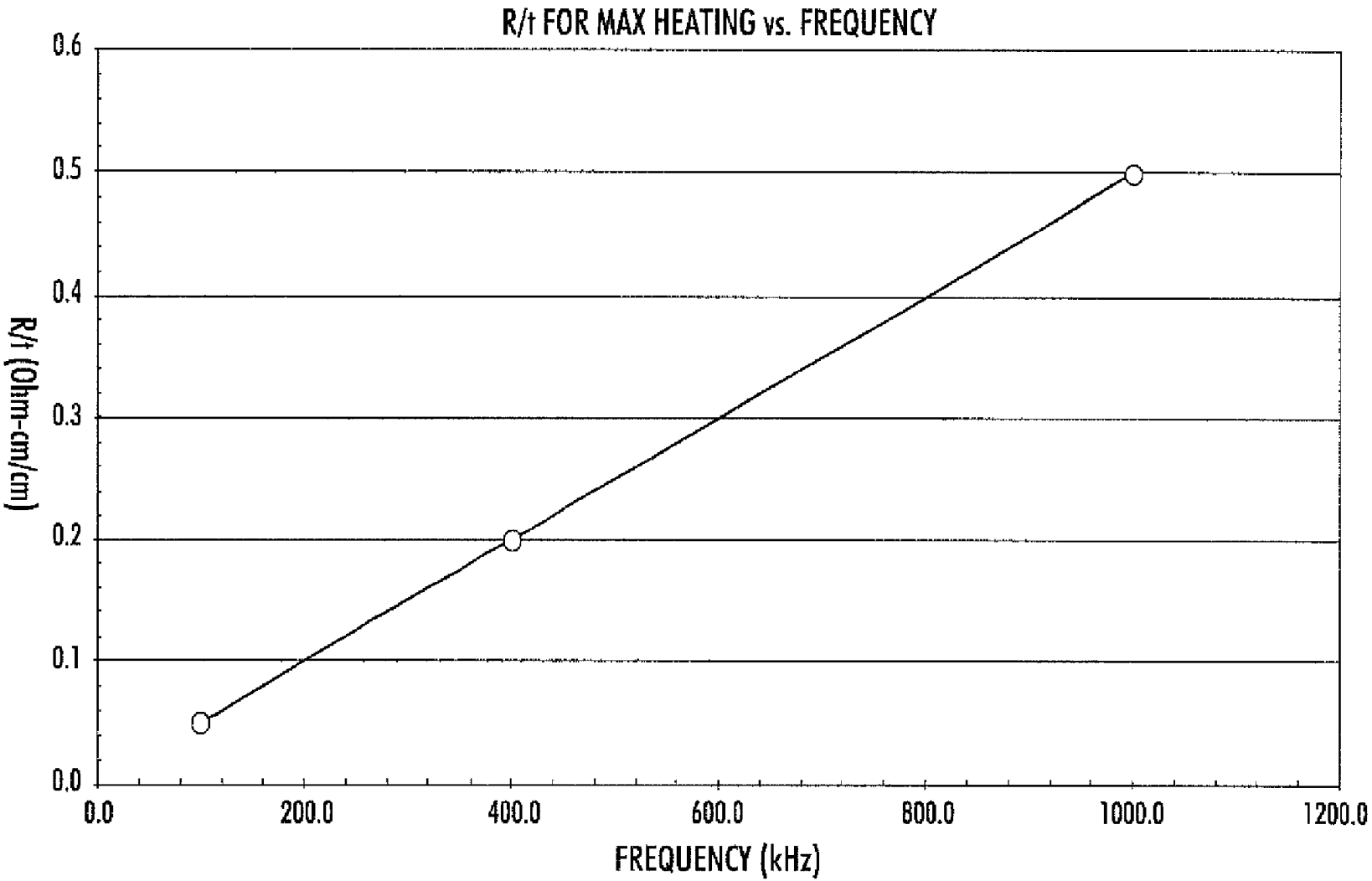
FIG. 8 is a chart depicting resistivity/thickness of susceptor layers according to the present teachings.

FIG. 8 is a chart depicting the resistivity/thickness of susceptor layers for which the maximum eddy current heating was achieved, as a function of power supply frequency. The measurements in the test cases depicted in FIG. 8 were obtained when a current of varying frequencies was applied to an induction coil. Further, the susceptor layers in the test cases had various resistivities and thicknesses.

For each test case depicted in FIG. 8, a combination of applied frequency (X-axis, in kHz) and resistivity/thickness (Y-axis, in ohm-cm/cm) were applied to determine the maximum eddy current heating per unit length (W/m) of the susceptor layer, as described with respect to FIG. 3. For example, as shown in FIG. 8, at an applied frequency of 400 kHz and with a susceptor layer having a resistivity/thickness of 0.2 ohm-cm/cm, a maximum eddy current heating was achieved in the susceptor layer. For further example, as shown in FIG. 8, at an applied frequency of 1000 kHz and with a susceptor laying having a resistivity/thickness of 0.5 ohm-cm/cm, a maximum eddy current heating was achieved in the susceptor layer. The overall results indicate that the optimal resistivity/thickness ratio of the susceptor layer depends on the applied frequency. More particularly, the optimal resistivity/thickness ratio in combination with the applied frequency achieves a maximum eddy current heating in a linear fashion.

While the present teachings have been illustrated with respect to one or more exemplary embodiments, alterations and/or modifications can be made to the illustrated examples without departing from the spirit and scope of the appended claims. In addition, while a particular feature of the present teachings may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items, such as, for example, "one or more of A and B," means A alone, B alone, or A and B.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An induction fusing system, comprising:

a heating component configured to contact an image receiving substrate and fuse toner deposited on the image receiving substrate, and comprising a susceptor layer that comprises a plurality of carbon nanotubes (CNTs); and an electrical coil positioned in proximity to the heating component and configured to conduct an electrical current, wherein inductive heating of the susceptor layer results when the electrical current is applied to the electrical coil.

2. The system of claim 1, wherein the heating component is part of a fuser belt.

3. The system of claim 1, wherein the heating component is part of an outer surface of one or more of a fuser roll, a pressure roll, and a donor roll.

4. The system of claim 1, wherein the electrical current is generated from a power source connected to the electrical coil.

5. The system of claim 1, wherein the susceptor layer comprises one of axially-conductive CNTs, axially-aligned CNTs, or non-aligned CNTs.

6. The system of claim 1, wherein the plurality of CNTs comprises a sheet of a non-woven CNT textile.

7. The system of claim 6, wherein the sheet of the non-woven CNT textile comprises one or more of a single-, double-, or multi-walled CNT.

8. The system of claim 1, wherein the electrical current is in a range of about 0.5 Amperes (A) to about 100 A, and at a frequency in a range of about 25 kilohertz (kHz) to about 1 MHz.

9. The system of claim 1, wherein a distance between the electrical coil and the heating component is in a range of about 10 μm to about 500 μm.

10. An induction fusing system, comprising:

a heating component configured to contact an image receiving substrate and fuse toner deposited on the image receiving substrate, and comprising a susceptor layer with a plurality of carbon nanotubes, the susceptor layer having a resistivity/thickness in a range of about 0.01 ohm-cm/cm to about 4.0 ohm-cm/cm; and an electrical coil positioned in proximity to the heating component and configured to conduct an electrical current, wherein inductive heating of the susceptor layer results when the electrical current is applied to the electrical coil.

11. The system of claim 10, wherein the susceptor layer comprises a sheet of a non-woven CNT textile.

12. The system of claim 11, wherein the sheet of the non-woven CNT textile comprises one of axially-conductive CNTs, axially-aligned CNTs, or non-aligned CNTs.

13. The system of claim 8, wherein the heating component is part of a fuser belt.

14. The system of claim 8, wherein the heating component is part of an outer surface of one or more of a fuser roll, a pressure roll, and a donor roll.

15. The system of claim 8, wherein the electrical current is in a range of about 0.5 Amperes (A) to about 100 A, and at a frequency in a range of about 25 kilohertz (kHz) to about 1 MHz.

16. The system of claim 8, wherein a distance between the electrical coil and the heating component is in a range of about 10 μm to about 100 μm.

17. A method for inductively heating a fusing member, comprising:

providing a heating component comprising at least one layer of CNTs;

providing an electrical coil located in proximity to the heating component;

conducting an electrical current through the electrical coil;

inductively heating the at least one layer of CNTs via the electrical current; and rotating the heated at least one layer of CNTs to fuse toner to an image-receiving substrate.

18. The method of claim 17, wherein the heating component is part of a fuser belt.

19. The method of claim 17, wherein the heating component is part of an outer surface of one or more of a fuser roll, a pressure roll, and a donor roll.

20. The method of claim 17, wherein the step of inductively heating the at least one layer of CNTs comprises generating eddy currents in the at least one layer of CNTs.

21. The method of claim 17, wherein the electrical current is in a range of about 0.5 A to about 10 A, and at a frequency in a range of about 25 kHz to about 700 kHz.

22. The method of claim 17, wherein a distance between the electrical coil and the heating component is in a range of about 10 μm to about 500 μm.

23. The method of claim 17, wherein the at least one layer of CNTs comprises a sheet of a non-woven CNT textile.

* * * * *